US006669397B1

(12) United States Patent
Christion

(10) Patent No.: US 6,669,397 B1
(45) Date of Patent: Dec. 30, 2003

(54) QUICK DISCONNECT TOOL APPARATUS

(76) Inventor: Woodson Christion, P.O. Box 281491, Nashville, TN (US) 37202

( * ) Notice: Subject to any disclaimer, the term of this patent is extended or adjusted under 35 U.S.C. 154(b) by 0 days.

(21) Appl. No.: 10/045,909

(22) Filed: Oct. 19, 2001

(51) Int. Cl.[7] ..... B25G 3/00; B25G 3/02; B25G 3/18; B25G 23/16

(52) U.S. Cl. ..... 403/322.2; 403/DIG. 6; 16/405; 16/429; 16/436; 15/105; 15/176.1; 15/176.6

(58) Field of Search ..... 403/322.2, DIG. 6; 15/105, 176.1, 176.6; 16/405, 429, 436

(56) References Cited

U.S. PATENT DOCUMENTS 3,544,173 A 12/1970 Senick et al.
4,829,857 A 5/1989 Jones
4,841,597 A 6/1989 Kolonia
5,228,202 A * 7/1993 Liao ..... 16/429
5,272,788 A 12/1993 Gilstrap
5,288,161 A 2/1994 Graves et al.
D355,819 S 2/1995 Price
5,447,572 A * 9/1995 LaClair ..... 15/105
5,937,473 A * 8/1999 Lisowski ..... 15/104.05
6,311,368 B1 * 11/2001 Sartori ..... 16/429
6,435,754 B1 * 8/2002 Canale ..... 403/322.2

* cited by examiner

*Primary Examiner*—Lynne H. Browne
*Assistant Examiner*—Ernesto Garcia

(57) ABSTRACT

A quick disconnect tool apparatus for permitting a user to utilize a single pole member in conjunction with a variety of yard tools. The quick disconnect tool apparatus includes an elongate pole member having a uniquely shaped aperture. Inside the aperture are bearing members surrounded by a sliding sleeve member designed to position the bearing members inwardly and outwardly with respect to the longitudinal axis of the pole. Tool members having a tool coupler with a groove are insertable into the aperture and are releasably secured when the bearing members engage the groove.

15 Claims, 2 Drawing Sheets

QUICK DISCONNECT TOOL APPARATUS

BACKGROUND OF THE INVENTION

1. Field of the Invention

The present invention relates to interchangeable tools and more particularly pertains to a new quick disconnect tool apparatus for permitting a user to utilize a single pole member in conjunction with a variety of yard tools.

2. Description of the Prior Art

The use of interchangeable tools is known in the prior art. U.S. Pat. No. 5,288,161 describes a device for quick release lock mechanisms. Another type of interchangeable tools is U.S. Pat. No. 5,272,788 having a threaded system allowing the user to attach various tools to a handle.

While these devices fulfill their respective, particular objectives and requirements, the need remains for a system that has the capability of adapting to various tool utilizing a quick release mechanism.

SUMMARY OF THE INVENTION

The present invention meets the needs presented above by having a first portion of a quick release coupling system on the end of the pole and a mating second portion of the quick release coupling system on the tools.

Still yet another object of the present invention is to provide a new quick disconnect tool apparatus that allows diversity in the number and types of tools the user desires to use.

Even still another object of the present invention is to provide a new quick disconnect tool apparatus that prevents the tool from rotating with regards to the pole once coupled, thereby completely securing the tool to the pole.

To this end, the present invention generally comprises an elongate pole member having a uniquely shaped aperture. Inside the aperture are bearing members surrounded by a sliding sleeve member designed to position the bearing members inwardly and outwardly with respect to the longitudinal axis of the pole. Tool members having a tool coupler with a groove are insertable into the aperture and are releasably secured when the bearing members engage the groove.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter f the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
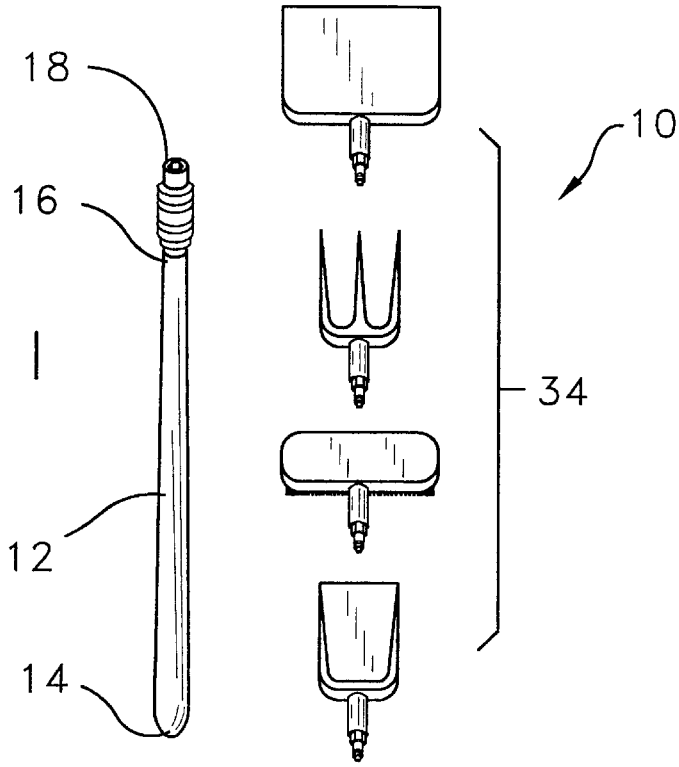
FIG. 1 is a schematic perspective view of the pole member and the some tool members of a new quick disconnect tool apparatus according to the present invention.
Figure 2:
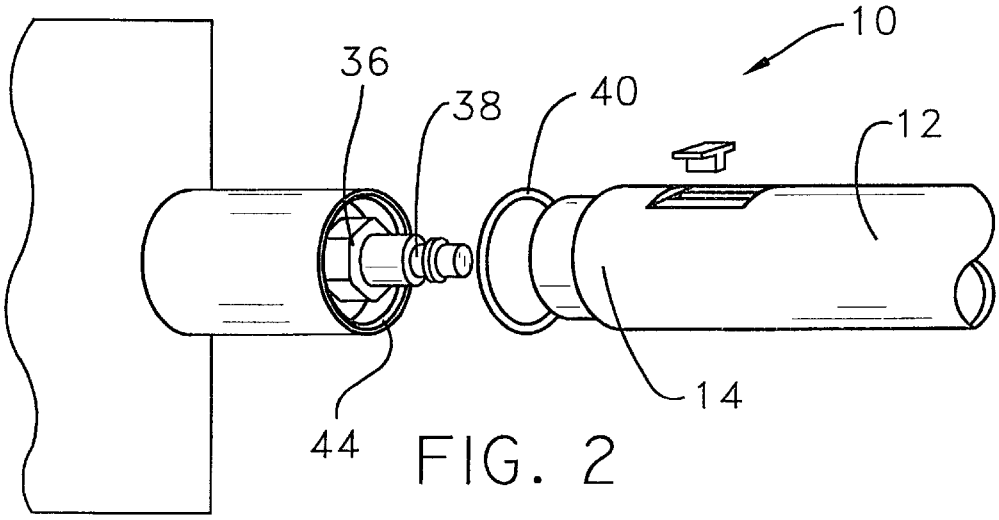
FIG. 2 is a schematic perspective exploded view showing the tool coupler of the present invention.
Figure 3:
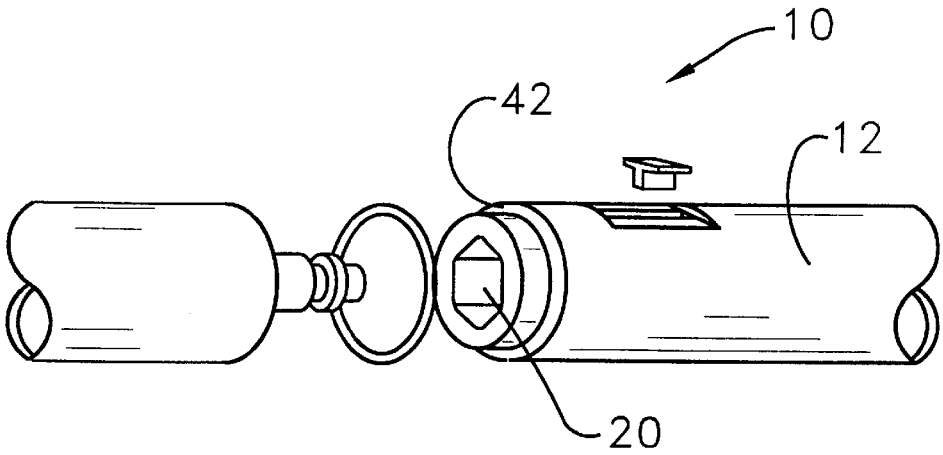
FIG. 3 is a schematic perspective exploded view showing the tool aperture of the present invention.
Figure 4:
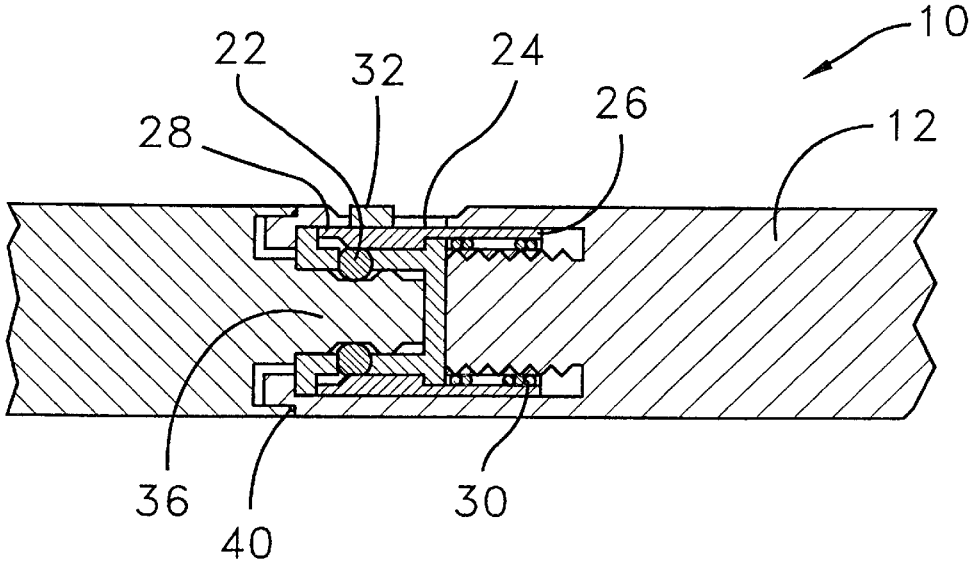
FIG. 4 is a schematic cross-sectional view of the present invention.

With reference now to the drawings, and in particular to FIGS. 1 through 4 thereof, a new quick disconnect tool apparatus embodying the principles and concepts of the present invention and generally designated by the reference numeral 10 will be described.

As best illustrated in FIGS. 1 through 4, the quick disconnect tool apparatus 10 generally comprises a pole member 12 that is elongate and has a first end 14 and a second end 16. The second end 16 forms a first coupler 18. The first coupler 18 includes a tool aperture 20.

A plurality of bearing members 22 is positioned inside of the tool aperture 20.

A bearing sleeve 24 is slidably positionable within the first coupler 18 and encompassing the bearing members 22. The bearing sleeve 24 has an inner end 26 and an outer end 28.

A biasing member 30 biases the bearing sleeve 24 towards the outer end 28 is positioned adjacent the inner end 26.

A knob 32 is attached to the bearing sleeve 24 for selectively positioning the sleeve member such that when the sleeve member is directed towards the inner end 26, the bearing members 22 are permitted to reposition outwardly.

A plurality of tool members 34 releasably attach to the pole member 12. Each of the tool members 34 has a tool coupler 36 for selectively coupling to the first coupler 18.

The tool coupler 36 has a shape conforming to the aperture such that rotation of the tool members 34 is restricted when coupled to the pole member 12.

The tool coupler 36 has a groove 38. The groove 38 has a width generally equal to a diameter of the bearing members 22 such that when the tool coupler 36*s* are inserted into the tool aperture 20, the bearing members 22 engage the groove 38 thereby releasably coupling the tool members 34 and the pole member 12.

A gasket member 40 prevents intrusion of moisture and debris into the aperture when the first coupler 18 and the tool coupler 36. are joined. The gasket member 40 is positioned on an outer ridge 42 of the pole member 12 such that a perimeter rim 44 of the tool members 34 abuts the gasket member 40 when the pole member 12 and the tool members 34 are joined.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A quick disconnect tool apparatus for permitting a user to utilize a single pole member in conjunction with a variety of yard tools, said apparatus comprising:

a pole member being elongate and having a first end and a second end, said second end forming a first coupler;

a plurality of tool members for releasably attaching to said pole member, each of said tool members having a tool coupler for selectively coupling to said first coupler;

a gasket member for preventing intrusion of moisture and debris into a tool aparture when said first coupler and said tool coupler being joined; and wherein said tool coupler having a shape conforming to said tool aperture such that rotation of said tool members is restricted when coupled to said pole member.

2. The quick disconnect tool apparatus as set forth in claim 1, further comprising a plurality of bearing members being positioned inside of said tool aperture.

3. A quick disconnect tool apparatus for permitting a user to utilize a single pole member in conjunction with a variety of yard tools, said apparatus comprising:

a pole member being elongate and having a first end and a second end, said second end forming a first coupler;

a plurality of tool members for releasably attaching to said pole member, each of said tool members having a tool coupler for selectively coupling to said first coupler;

wherein said first coupler including a tool aperture;

a plurality of bearing members being positioned inside of said tool aperture; and a bearing sleeve being slidably positionable within said first coupler and encompassing said bearing members.

4. The quick disconnect tool apparatus as set forth in claim 3, wherein said bearing sleeve having an inner end and an outer end.

5. The quick disconnect tool apparatus as set forth in claim 3, further comprising a biasing member for biasing said bearing sleeve towards said outer end being positioned adjacent said inner end.

6. The quick disconnect tool apparatus as set forth in claim 3, further comprising a knob being attached to said bearing sleeve for selectively positioning said sleeve member such that when said sleeve member is directed towards said inner end, said bearing members are permitted to reposition outwardly.

7. The quick disconnect tool apparatus as set forth in claim 2, further comprising said tool coupler having a groove.

8. The quick disconnect tool apparatus as set forth in claim 7, wherein said groove having a width generally equal to a diameter of said bearing members such that when one of the said tool couplers are inserted into said tool aperture said bearing members engage said groove thereby releasably coupling said tool members and said pole member.

9. The quick disconnect tool apparatus as set forth in claim 3, further comprising a gasket member for preventing intrusion of moisture and debris into said aperture when said first coupler and said tool coupler being joined.

10. A quick disconnect tool apparatus for permitting a user to utilize a single pole member in conjunction with a variety of yard tools, said apparatus comprising:

a pole member being elongate and having a first end and a second end, said second end forming a first coupler, a plurality of tool members for releasably attaching to said pole member, each of said tool members having a tool coupler for selectively coupling to said first coupler; and a gasket member for preventing intrusion of moisture and debris into a tool aparture when said first coupler and said tool coupler being joined; and said gasket member being positioned on an outer ridge of said pole member such that a perimeter rim of said tool members abut said gasket member when said pole member and said tool members are joined.

11. A quick disconnect tool apparatus for permitting a user to utilize a single pole member in conjunction with a variety of yard tools, said apparatus comprising:

a pole member being elongate and having a first end and a second end, said second end forming a first coupler, said first coupler including:

a tool aperture;

a plurality of bearing members being positioned inside of said tool aperture;

a bearing sleeve being slidably positionable within said first coupler and encompassing said bearing members, said bearing sleeve having an inner end and an outer end;

a biasing member for biasing said bearing sleeve towards said outer end being positioned adjacent said inner end;

a knob being attached to said bearing sleeve for selectively positioning said sleeve member such that when said sleeve member is directed towards said inner end, said bearing members are permitted to reposition outwardly;

a plurality of tool members for releasably attaching to said pole member, each of said tool members having a tool coupler for selectively coupling to said first coupler, said tool coupler having a shape conforming to said tool aperture such that rotation of said tool members is restricted when coupled to said pole member, said tool coupler having a groove, said groove having a width generally equal to a diameter of said bearing members such that when said tool couplers are inserted into said tool aperture said bearing members engage said groove thereby releasably coupling said tool members and said pole member; and a gasket member for preventing intrusion of moisture and debris into said tool aperture when said first coupler and said tool coupler being joined, said gasket member being positioned on an outer ridge of said pole member such that a perimeter rim of said tool members abut said gasket member when said pole member and said tool members are joined.

12. The quick disconnect tool apparatus as set forth in claim 3, wherein said tool coupler having a shape conforming to said tool aperture such that rotation of said tool members is restricted when coupled to said pole member.

13. The quick disconnect tool apparatus as set forth in claim 3, further comprising said tool coupler having a groove.

14. The quick disconnect tool apparatus as set forth in claim 13, wherein said groove having a width generally equal to a diameter of said bearing members such that when said tool couplers are inserted into said tool aperture said bearing members engage said groove thereby releasably coupling said tool members and said pole member.

15. The quick disconnect tool apparatus as set forth in claim 9, further comprising said gasket member being positioned on an outer ridge of said pole member such that a perimeter rim of said tool members abut said gasket member when said pole member and said tool members are joined.

* * * * *